US007060002B1

(12) United States Patent
Boehme

(10) Patent No.: US 7,060,002 B1
(45) Date of Patent: Jun. 13, 2006

(54) PHYSICAL FITNESS COURSE

(76) Inventor: Theodore F. Boehme, 9025 Lake Lynn Dr., Sebring, FL (US) 33876

( * ) Notice: Subject to any disclaimer, the term of this patent is extended or adjusted under 35 U.S.C. 154(b) by 457 days.

(21) Appl. No.: 10/274,550

(22) Filed: Oct. 21, 2002

(51) Int. Cl.
*A63B 9/00* (2006.01)

(52) U.S. Cl. ..... 482/35

(58) Field of Classification Search ..... 482/35–38, 482/121–125, 114, 83–90; 472/117–118, 472/128

See application file for complete search history.

(56) References Cited

U.S. PATENT DOCUMENTS 3,764,446 A * 10/1973 Martin ..... 428/52
3,806,118 A * 4/1974 Way ..... 273/449
3,814,416 A * 6/1974 Munger et al. ..... 482/36
3,944,654 A * 3/1976 Moore ..... 482/34
4,251,069 A * 2/1981 Beller ..... 482/36
4,252,313 A * 2/1981 Skalka ..... 482/36
4,272,126 A * 6/1981 Cadle ..... 297/271.5
4,378,112 A * 3/1983 Goldstein ..... 482/34
4,943,046 A * 7/1990 Beltzig ..... 482/35
D314,025 S * 1/1991 Shimer ..... D21/691
5,466,205 A * 11/1995 McLane et al. ..... 482/140
5,557,900 A * 9/1996 Shaneour ..... 52/736.3
5,599,258 A * 2/1997 Stone et al. ..... 482/52
5,662,525 A * 9/1997 Briggs ..... 472/128
5,865,680 A * 2/1999 Briggs ..... 472/128
5,899,835 A * 5/1999 Puranda ..... 482/90
5,967,093 A * 10/1999 Vitt et al. ..... 119/705
5,989,158 A * 11/1999 Fredette ..... 482/38
6,120,415 A * 9/2000 Paull et al. ..... 482/38
6,156,106 A * 12/2000 Kamata ..... 96/189
6,283,871 B1 * 9/2001 Briggs ..... 472/136
6,315,701 B1 * 11/2001 Shifferaw ..... 482/114
6,432,027 B1 * 8/2002 Haselrig ..... 482/83
6,749,549 B1 * 6/2004 Chu ..... 482/148

OTHER PUBLICATIONS

Fit-Trail Catalog, copyright 1990 www.fittrail.com.*

* cited by examiner

*Primary Examiner*—Jerome Donnelly
*Assistant Examiner*—Fenn C. Mathew

(57) ABSTRACT

A physical fitness course for providing an inexpensive workout course comprising primarily of PVC material. The physical fitness course includes a pull-up exercise unit being securely situated upon a ground; and also includes sit-up units being disposed upon the ground; and further includes a body lift/push-ups unit also being securely situated upon the ground; and also includes a leg/torso-stretching unit being securely situated upon the ground; and further includes weight-lifting/twist-up units being securely disposed upon the ground; and also includes a multiple muscle exercise unit including a pole being attached to a concrete base member and being filled with a concrete substance for a user to push against with one's back; and further includes step-up units including a plurality of cylindrical pods being spacedly and securely disposed upon the ground and being connected to concrete base members; and also includes a jumping unit including a plurality of elongate tubular members being attached side-by-side and being horizontally-disposed above the ground; and further includes a sit and reach unit being securely disposed upon the ground.

5 Claims, 8 Drawing Sheets

PHYSICAL FITNESS COURSE

BACKGROUND OF THE INVENTION

1. Field of the Invention

The present invention relates to physical fitness stations and more particularly pertains to a new physical fitness course for providing an inexpensive workout course comprising primarily of PVC material.

2. Description of the Prior Art

The use of physical fitness stations is known in the prior art. More specifically, physical fitness stations heretofore devised and utilized are known to consist basically of familiar, expected and obvious structural configurations, notwithstanding the myriad of designs encompassed by the crowded prior art which have been developed for the fulfillment of countless objectives and requirements.

The prior art includes various apparatus being used for exercising purposes. While these devices fulfill their respective, particular objectives and requirements, the aforementioned prior art do not disclose a new physical fitness course.

SUMMARY OF THE INVENTION

The general purpose of the present invention, which will be described subsequently in greater detail, is to provide a new physical fitness course which has many of the advantages of the physical fitness stations mentioned heretofore and many novel features that result in a new physical fitness course which is not anticipated, rendered obvious, suggested, or even implied by any of the prior art physical fitness stations, either alone or in any combination thereof. The present invention includes a pull-up exercise unit being securely situated upon a ground; and also includes sit-up units being disposed upon the ground; and further includes a body lift/push-ups unit also being securely situated upon the ground; and also includes a leg/torso-stretching unit being securely situated upon the ground; and further includes weight-lifting/twist-up units being securely disposed upon the ground; and also includes a multiple muscle exercise unit including a pole being attached to a concrete base member and being filled with a concrete substance for a user to exercise one's muscles; and further includes step-up units including a plurality of cylindrical pods being spacedly and securely disposed upon the ground and being connected to concrete base members; and also includes a jumping unit including a plurality of elongate tubular members being attached side-by-side and being horizontally-disposed above the ground; and further includes a sit and reach unit being securely disposed upon the ground. None of the prior art includes the combination of elements of the present invention.

There has thus been outlined, rather broadly, the more important features of the physical fitness course in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

It is an object of the present invention to provide a new physical fitness course which has many of the advantages of the physical fitness stations mentioned heretofore and many novel features that result in a new physical fitness course which is not anticipated, rendered obvious, suggested, or even implied by any of the prior art physical fitness stations, either alone or in any combination thereof.

Still another object of the present invention is to provide a new physical fitness course for providing an inexpensive workout course comprising primarily of PVC material.

Still yet another object of the present invention is to provide a new physical fitness course that is easy and convenient to set up and use.

Even still another object of the present invention is to provide a new physical fitness course that would virtually be maintenance free.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
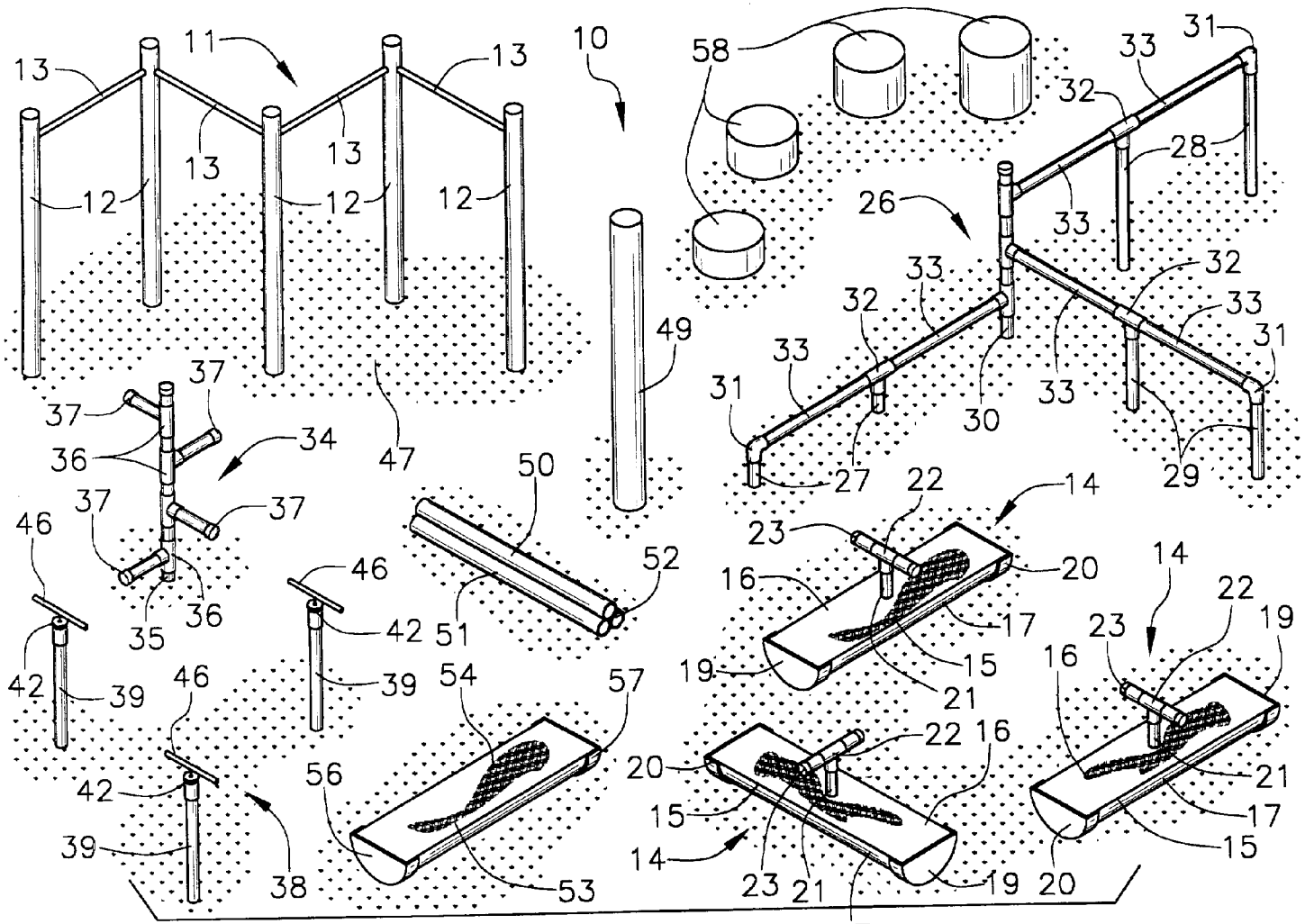
FIG. 1 is a perspective view of a new physical fitness course according to the present invention.
Figure 2:
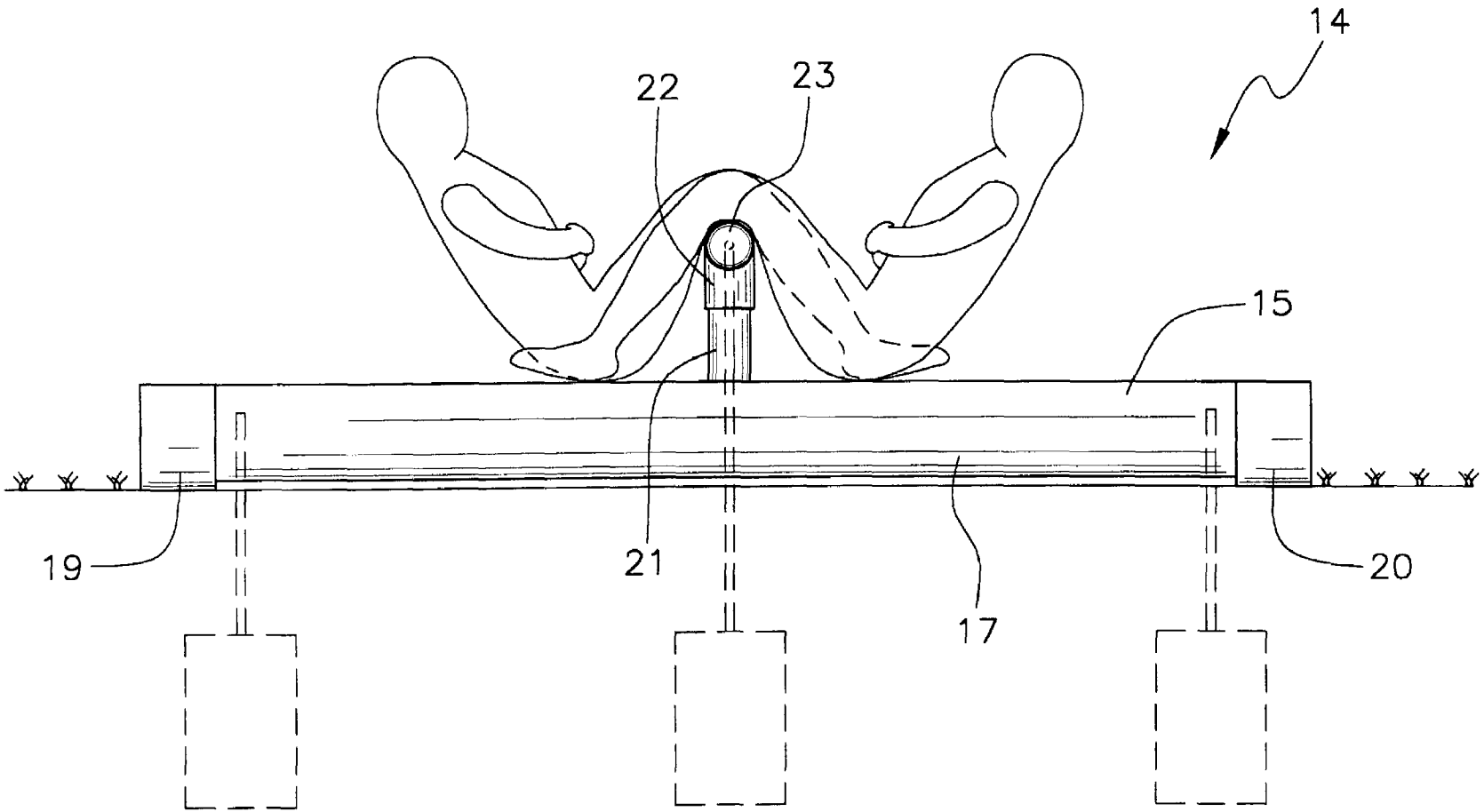
FIG. 2 is a side elevational view of the sit-ups unit of the present invention.
Figure 3:
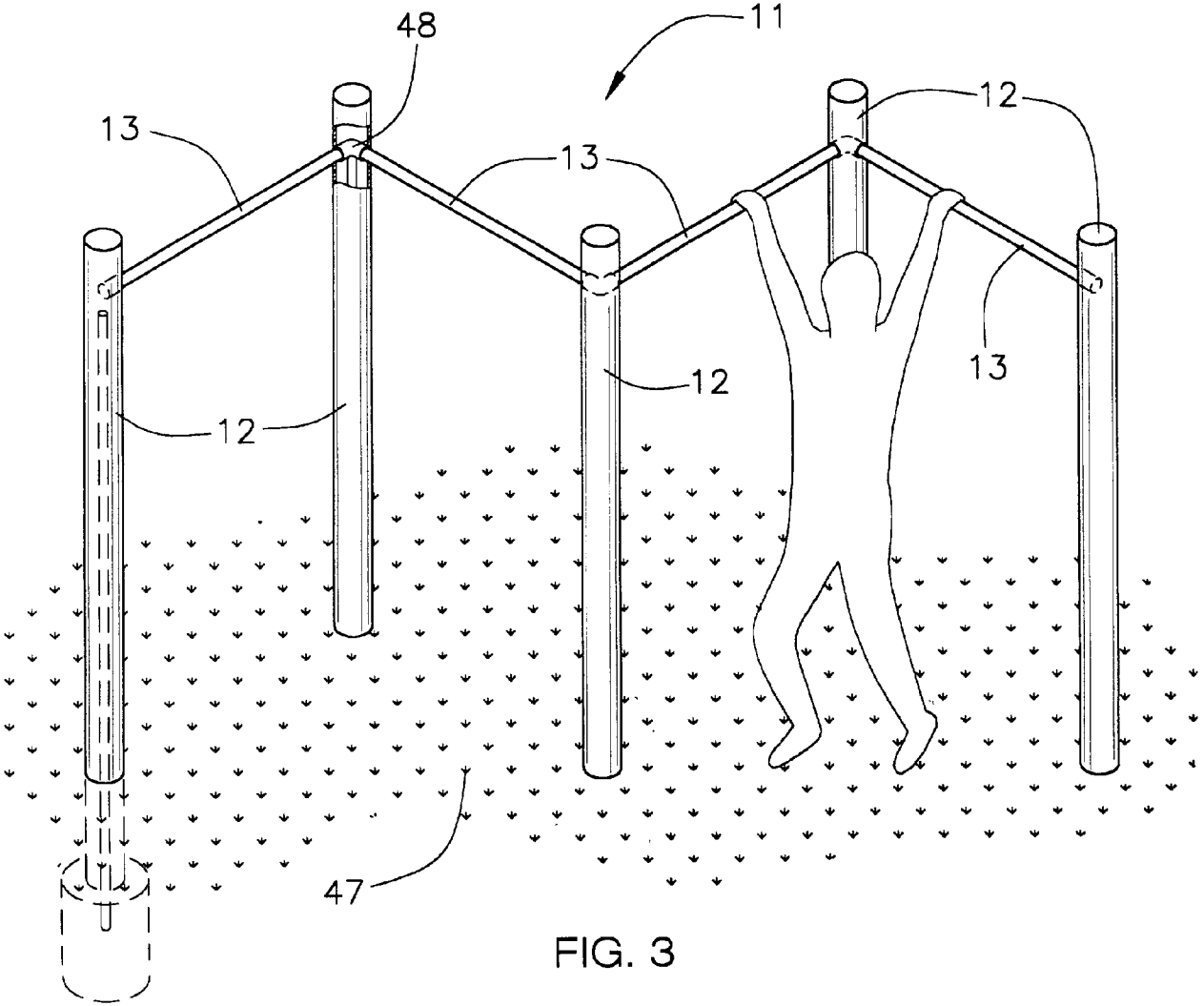
FIG. 3 is a perspective view of the pull-up exercise unit of the present invention.
Figure 4:
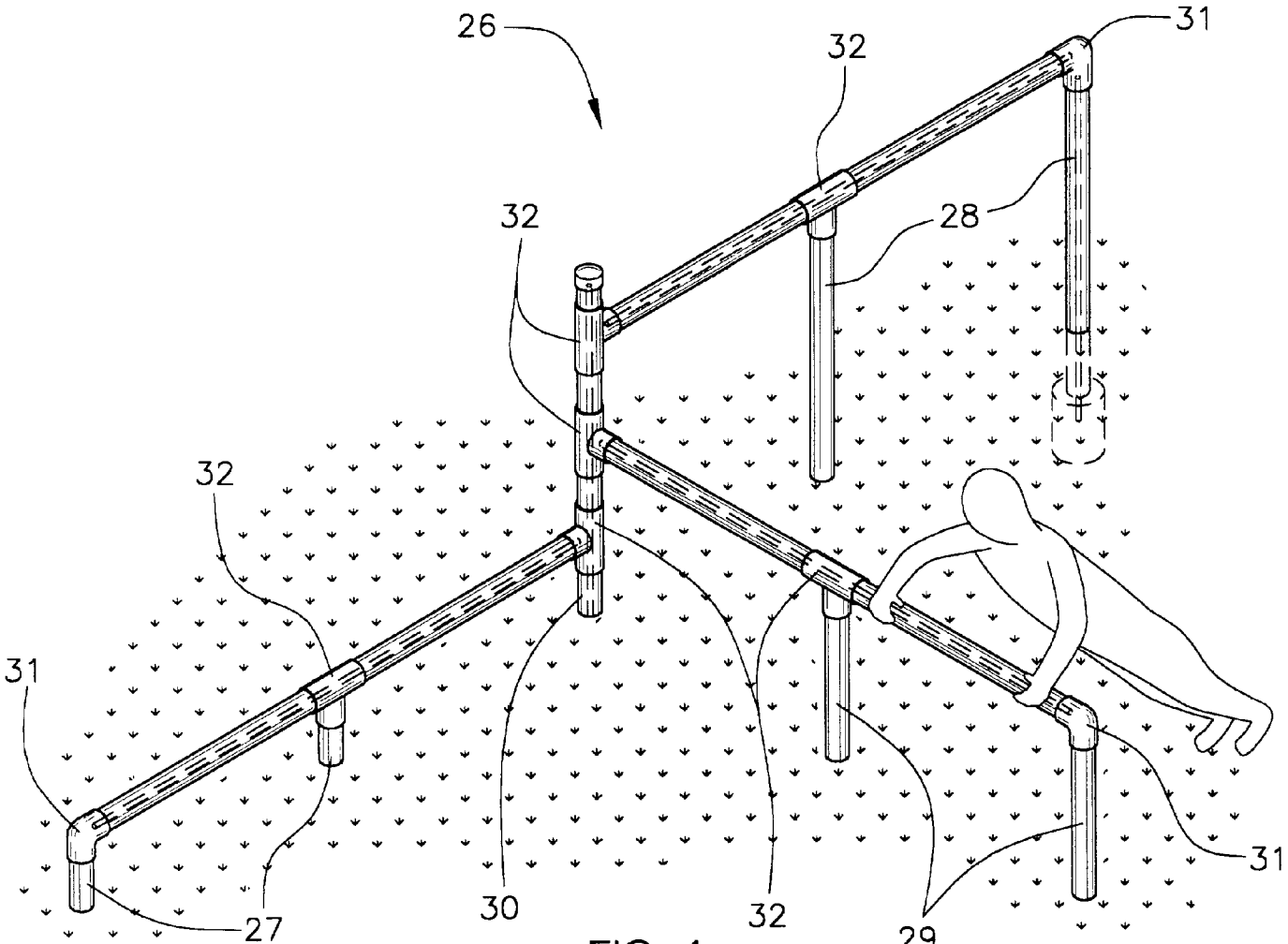
FIG. 4 is a perspective view of the torso-stretching unit of the present invention.
Figure 6:
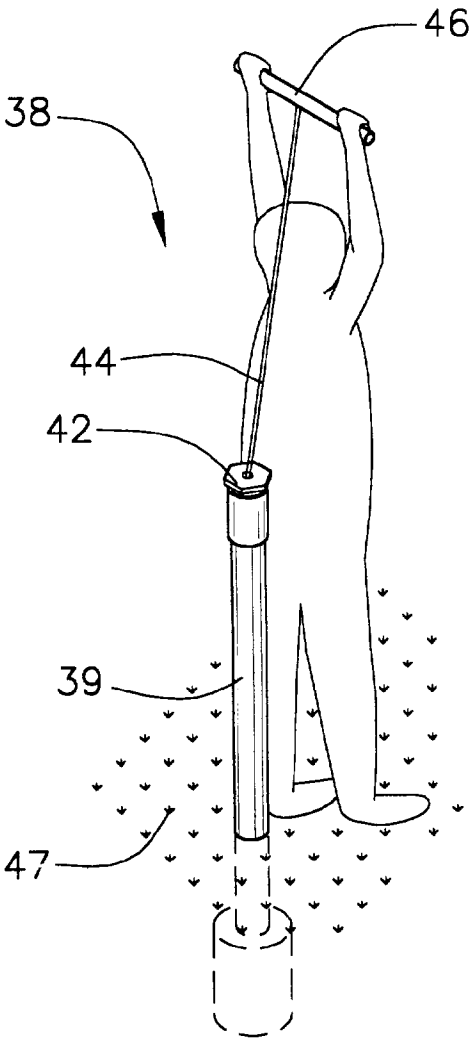
FIG. 6 is a perspective view of the weight-lifting unit of the present invention.
Figure 5:
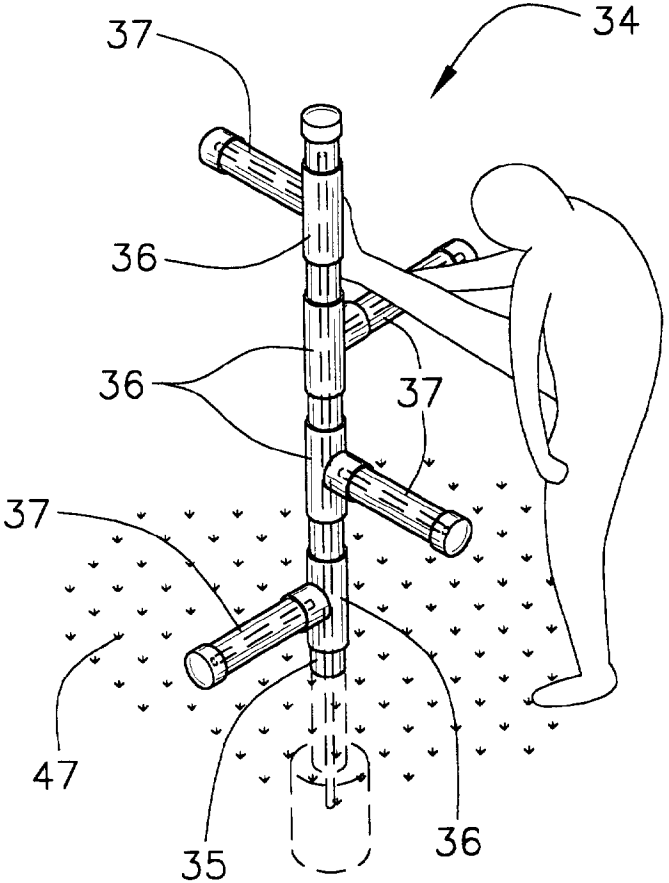
FIG. 5 is a perspective view of the leg/torso-stretching unit of present invention.
Figure 7:
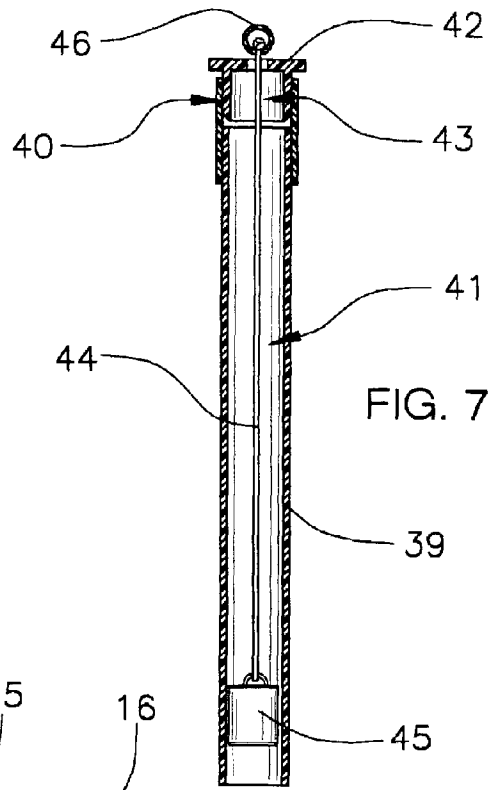
FIG. 7 is a cross-sectional view of the weight-lifting unit of the present invention.
Figure 8:
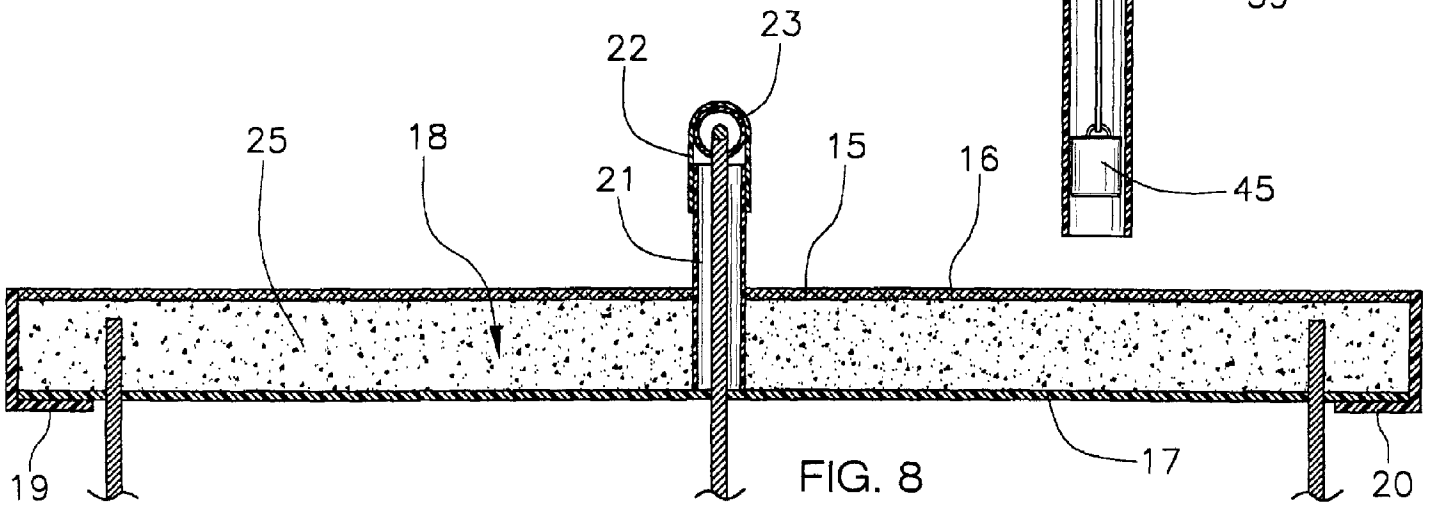
FIG. 8 is a cross-sectional view of sit-ups unit of the present invention.
Figure 10:
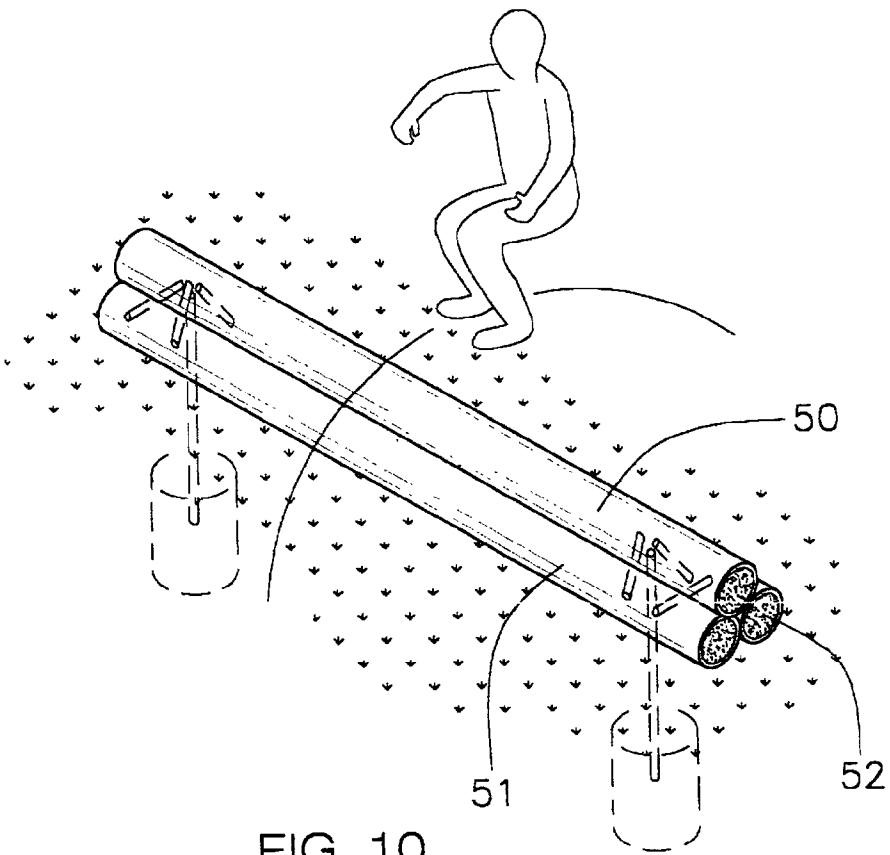
FIG. 10 is a perspective view of the jumping unit of the present invention.
Figure 9:
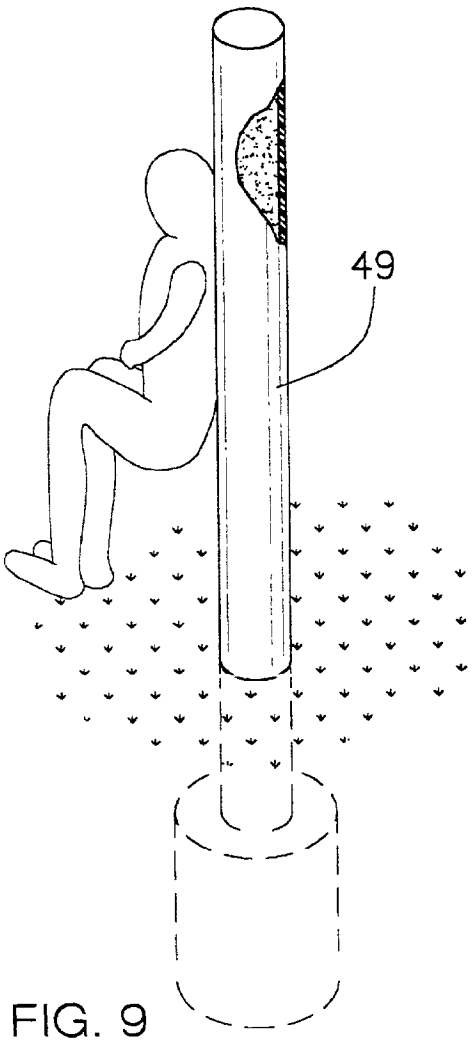
FIG. 9 is a perspective view of the multiple muscle exercise unit of present invention.
Figure 11:
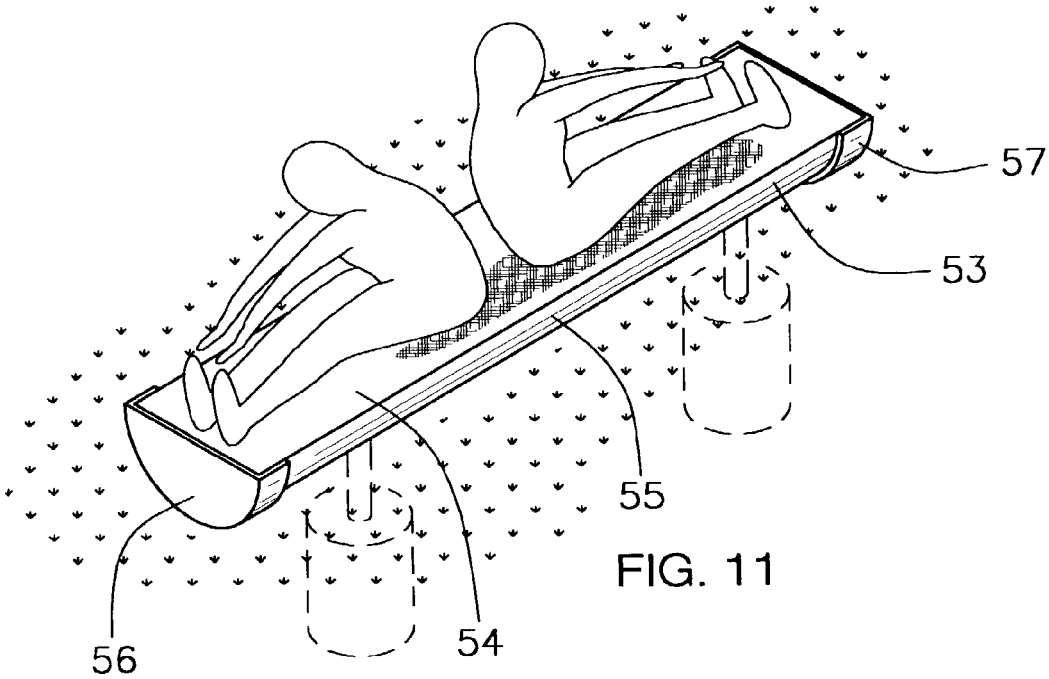
FIG. 11 is a perspective view of the sit and reach unit of the present invention.
Figure 12:
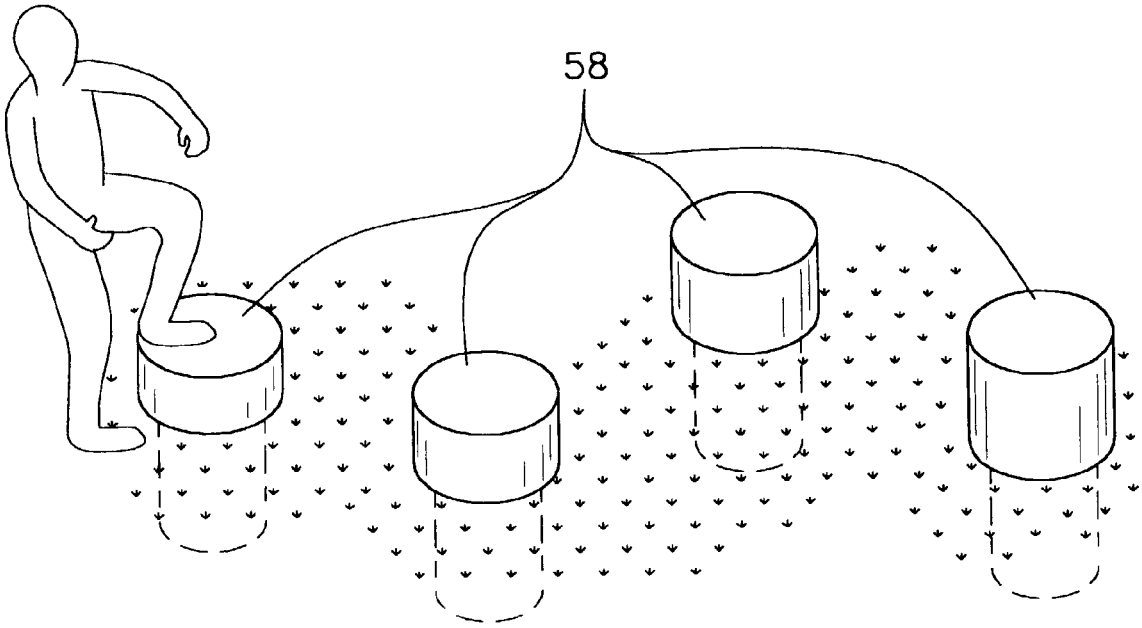
FIG. 12 is a perspective view of step-up units of the present invention.

With reference now to the drawings, and in particular to FIGS. 1 through 12 thereof, a new physical fitness course embodying the principles and concepts of the present invention and generally designated by the reference numeral 10 will be described.

As best illustrated in FIGS. 1 through 12, the physical fitness course 10 generally comprises a pull-up exercise unit 11 being securely situated upon a ground 47. The pull-up exercise unit 11 includes a plurality of elongate support members 12 being spaced apart and having support rods disposed therein and being and being filled with a concrete substance and being conventionally and vertically-erected in concrete base members which are imbedded in the ground 47, and further includes elbow-shaped connectors 48 being conventionally disposed in selected elongate support members 12, also includes a plurality of bars 13 having ends being securely and conventionally attached near top ends of the elongate support members 12 with the plurality of bars 13 interconnecting being attached to the elbow-shaped connectors to interconnect the elongate support members 12 and being adapted to support a user thereupon.

Sit-up units 14 are conventionally and securely disposed upon the ground and are attached to concrete base members that are embedded in the ground. Each sit-up unit 14 includes a bench member 15 having a top wall 16, and also includes leg support members 21–23 being conventionally attached to the top wall of 16 the bench member 15, and further includes concrete substance 25 being disposed in the bench member 15. The bench member 15 also has an arcuate bottom wall 17 having longitudinal edges which are conventionally attached to the top wall 16, and further has an internal cavity 18 which is filled with the concrete substance 25, and also has open ends which are capped with cap members 19,20. The bench member 15 is generally made of PVC material. Each sit-up unit 14 also includes a sheet of carpet-like material being conventionally disposed upon the top wall 16 of a respective bench member 15. The leg support member 21–23 includes a stub shaft 21 being conventionally disposed in the bench member 15 and extends upwardly therefrom, and also includes a T-shaped coupler 22 being removably engaged upon the stub shaft 21, and further includes a cross member 23 being removably engaged through the T-shaped coupler 22.

A body lift/push-up unit 26 is also securely and conventionally situated upon the ground 47. The body lift/push-up unit 26 includes a plurality of posts 27–30 being spaced apart and having support rods disposed therein and being filled with a concrete substance and being securely and vertically-erected upon the ground 47 and conventionally attached to concrete base members which are embedded in the ground, and also includes connectors 31–32 being conventionally mounted to the posts 27–30, and further includes bar members 33 being removably engaged to the connectors 31–32 and interconnecting the posts 27–30. The posts 27–30 include short posts 27 which are spacedly aligned to one another, and also include long posts 28 which are spacedly aligned to one another, and further include intermediate posts 29 which are spacedly aligned to one another, and also include a base post 30 which is spacedly aligned to the short, long, and intermediate posts 27–29. The connectors 31–32 include elbow connectors 32 which are mounted upon one of the short posts 27, one of the long posts 28, and one of the intermediate posts 29, and also includes T-shaped connectors 32 which are mounted to the other the short, long and intermediate posts 27–29 and about the base post 30.

A leg/torso-stretching unit 34 is securely and conventionally situated upon the ground 47 and conventionally attached to concrete base members that are embedded in the ground. The leg/torso-stretching unit 34 includes a base pole 35 being securely and vertically-erected upon the ground 47 and having a support rod disposed therein and being filled with a concrete substance, and also includes a plurality of T-shaped connecting members 36 being mounted about the base pole 35, and further includes a plurality of arms 37 being conventionally attached to the T-shaped connecting members 36 and extending outwardly generally perpendicular to the base pole 35.

Weight-lifting/twist-up units 38 are securely and conventionally disposed upon the ground 47 and are conventionally attached to a concrete base member that is embedded in the ground. Each weight-lifting/twist-up unit 38 includes an elongate tubular base member 39 being securely and vertically-erected upon the ground 47 and having an open top end 40 and a bore 41 disposed therein, and also includes a plug member 42 being removably engaged in the open top end 40 of the elongate tubular base member 39 and having a bore 43 being disposed therethrough, and further includes a flexible line 44 being movably disposed in the bore 41 of the elongate tubular base member 39 and through the bore 43 of the plug member 42, and also includes a weight member 45 being conventionally attached to a bottom end of the flexible line 44 and being movably disposed in the bore 41 of the elongate tubular base member 39, and further includes a rod-shaped handle member 46 being conventionally attached to a top end of the flexible line 44 and being adapted to be grasped by the hands of the user for performing military types of presses and also torso twist-ups.

A multiple muscle exercise unit includes a pole 49 being conventionally attached to a concrete base member and being filled with a concrete substance for a user to exercise a number of muscles in one's body. Step-up units include a plurality of cylindrical pods 58 being spacedly and securely disposed upon the ground and being conventionally connected to concrete base members. A jumping unit includes a plurality of elongate tubular members 50–52 are conventionally attached side-by-side and being horizontally-disposed above the ground and being filled with concrete substance.

A sit and reach unit is securely and conventionally disposed upon the ground. The sit and reach unit includes a bench member 53 having a top wall 54 and being conventionally attached to concrete base members, and also includes concrete substance being disposed in the bench member 53. The bench member 53 also has an arcuate bottom wall 55 having longitudinal edges which are conventionally attached to the top wall, and further has an internal cavity which is filled with the concrete substance, and also has open ends which are capped with cap members 56,57. The bench member 53 is generally made of PVC material. The sit and reach unit also includes a sheet of carpet-like material being conventionally disposed upon the top wall 54 of the bench member 53.

In use, the user would perform certain types of exercises at each of the units such as sit-ups and crunches upon the sit-ups unit 14, and also pull-ups upon the pull-up exercise unit 11, and further body lifts/push-ups on the torso-stretching unit 26, and also leg stretching on the leg/torso-stretching unit 34, and overhead arm lifts and body twists on the weight-lifting/twist-ups unit 38, and also step-ups upon the step-up units, and sit and stretch exercises upon the sit and reach unit, and jumping exercises over the jumping unit, and multiple muscle exercises against the pole 49.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the physical fitness course. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A physical fitness course kit comprising:

a pull-up exercise unit being securely situated upon a ground and including a plurality of elongate support members being spaced apart and having support rods disposed therein and being filled with concrete substance and being vertically-erected upon the ground and being conventionally attached to concrete base members which are embedded in the ground, and further including elbow-shaped connectors being disposed in selected said elongate support members, and also including a plurality of bars having ends securely attached near top ends of said elongate support members, said plurality of bars being attached to said elbow-shaped connectors and interconnecting said elongate support members and being adapted to support a user thereupon;

sit-up units being securely disposed upon the ground, each of said sit-up units including a bench member having a top wall and being attached to a concrete base member, and also including a leg support member being attached to said top wall of said bench member, and further including concrete substance being disposed in each said bench member, said bench member also having an arcuate bottom wall having longitudinal edges which are attached to said top wall, and further having an internal cavity which is filled with said concrete substance, and also having open ends which are capped with cap members, said bench member being generally made of PVC material;

a body lift/push-ups unit also being securely situated upon the ground;

a leg/torso-stretching unit being securely situated upon the ground;

weight-lifting/twist-up units being securely disposed upon the ground;

a multiple muscle exercise unit including a pole being attached to a concrete base member and being filled with a concrete substance for a user to exercise one's muscles, step-up units including a plurality of cylindrical pods being spacedly and securely disposed upon the ground and being connected to concrete base members;

jumping unit including a plurality of elongate tubular members being attached side-by-side and being horizontally-disposed above the ground; and a sit and reach unit being securely disposed upon the ground.

2. The physical fitness course kit as described in claim 1, wherein each of said sit-ups unit also includes a sheet of carpet-like material being disposed upon said top wall of a respective said bench member.

3. The physical fitness course kit as described in claim 1, wherein said leg support member includes a stub shaft being disposed in said bench member and extending upwardly therefrom, and also includes a T-shaped coupler being removably engaged upon said stub shaft, and further includes a cross member being removably engaged through said T-shaped coupler.

4. A physical fitness course kit comprising:

a pull-up exercise unit being securely situated upon a ground and including a plurality of elongate support members being spaced apart and having support rods disposed therein and being filled with concrete substance and being vertically-erected upon the ground and being conventionally attached to concrete base members which are embedded in the ground, and further including elbow-shaped connectors being disposed in selected said elongate support members, and also including a plurality of bars having ends securely attached near top ends of said elongate support members, said plurality of bars being attached to said elbow-shaped connectors and interconnecting said elongate support members and being adapted to support a user thereupon;

sit-up units being securely disposed upon the ground, each of said sit-up units including a bench member having a top wall and being attached to a concrete base member, and also including a leg support member being attached to said top wall of said bench member, and further including concrete substance being disposed in each said bench member;

a bode lift/push-ups unit also being securely situated upon the ground and including a plurality of posts being spaced apart and having support rods disposed therein and also being filled with a concrete substance and being securely and vertically-erected upon the ground and conventionally attached to concrete base members which are embedded in the ground, and also including connectors being mounted to said posts, and further including bar members being removably engaged to said connectors and interconnecting said posts, said posts including short posts which are spacedly aligned to one another, and also including long posts which are spacedly aligned to one another, and further including intermediate posts which are spacedly aligned to one another, and also including a base post which is spacedly aligned to said short, long, and intermediate posts, said connectors including elbow connectors which are mounted upon one of said short posts, one of said long posts, and one of said intermediate posts, and also including T-shaped connectors which are mounted to the other said short, long and intermediate posts and to said base post;

a leg/torso-stretching unit being securely situated upon the ground and including a base pole having a support rod disposed therein and also being filled with a concrete substance and being securely and vertically-erected upon the ground and conventionally attached to a concrete base member which is embedded in the ground, and also including a plurality of T-shaped connecting members being mounted to said base pole, and further including a plurality of arms being securely attached to said T-shaped connecting members and extending outwardly generally perpendicular to said base pole;

weight-lifting/twist-up units being securely disposed upon the ground, each of said weight-lifting/twist-up units including an elongate tubular base members being securely and vertically-erected upon the ground and conventionally attached to concrete base members which are embedded in the ground and having an open top end and a bore disposed therein, and also including a plug members being removably engaged in said open top end of said elongate tubular base member and having a bore being disposed therethrough, and further including a flexible line being movably disposed in said bore of said elongate tubular base member and through said bore of said plug member, and also including a weight member being attached to a bottom end of said flexible line and being movably disposed in said bore of said elongate tubular base member, and further including a rod-shaped handle member being attached to a top end of said flexible line and being adapted to grasped by the hands of the user for performing military types of presses and torso twist-ups;

a multiple muscle exercise unit including a pole being attached to a concrete base member and being filled with a concrete substance for a user to exercise one's muscles, step-up units including a plurality of cylindrical pods being spacedly and securely disposed upon the ground and being connected to concrete base members;

jumping unit including a plurality of elongate tubular members being attached side-by-side and being horizontally-disposed above the ground; and a sit and reach unit being securely disposed upon the ground.

5. The physical fitness course kit as described in claim 4, wherein said sit and reach unit includes a bench member having a top wall and being attached to a concrete base member, and further includes concrete substance being disposed in said bench member, said bench member also having an arcuate bottom wall having longitudinal edges which are attached to said top wall, and further having an internal cavity which is filled with said concrete substance, and also has open ends which are capped with cap members, said bench member being generally made of PVC material, said sit and reach unit also including a sheet of carpet-like material being disposed upon said top wall of said bench member.

* * * * *